US010934684B2

(12) United States Patent
Wetzel et al.

(10) Patent No.: US 10,934,684 B2
(45) Date of Patent: Mar. 2, 2021

(54) CONTROL SYSTEM FOR POWER MACHINE

(71) Applicant: Clark Equipment Company, West Fargo, ND (US)

(72) Inventors: Michael D. Wetzel, Bismarck, ND (US); Jonathan J. Roehrl, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 48 days.

(21) Appl. No.: 16/177,864

(22) Filed: Nov. 1, 2018

(65) Prior Publication Data

US 2019/0127953 A1 May 2, 2019

Related U.S. Application Data

(60) Provisional application No. 62/580,162, filed on Nov. 1, 2017.

(51) Int. Cl.

| | |
|---|---|
| ***E02F 9/20*** | (2006.01) |
| ***E02F 3/96*** | (2006.01) |
| ***E02F 9/02*** | (2006.01) |
| ***E02F 3/32*** | (2006.01) |
| *E02F 9/12* | (2006.01) |

(52) U.S. Cl.

CPC ..... *E02F 9/2012* (2013.01); *E02F 3/325* (2013.01); *E02F 3/964* (2013.01); *E02F 9/02* (2013.01); *E02F 9/123* (2013.01)

(58) Field of Classification Search

CPC . E02F 9/2012; E02F 3/325; E02F 9/02; E02F 3/964

See application file for complete search history.

(56) References Cited

U.S. PATENT DOCUMENTS

| | | | | |
|---|---|---|---|---|
| 7,712,555 | B2 * | 5/2010 | Krieger | F15B 11/17 180/6.3 |
| 9,963,856 | B2 * | 5/2018 | Takahashi | E02F 9/2296 |
| 2004/0060288 | A1 * | 4/2004 | Wetzel | B60K 31/08 60/435 |
| 2004/0060747 | A1 * | 4/2004 | Wetzel | E02F 9/2253 180/9.44 |
| 2005/0102866 | A1 | 5/2005 | Sewell et al. | |
| 2009/0044434 | A1 * | 2/2009 | Breuer | E02F 3/7618 37/410 |
| 2016/0032564 | A1 * | 2/2016 | Pinther, II | E02F 9/2012 60/327 |
| 2017/0274947 | A1 | 9/2017 | Haugen | |

FOREIGN PATENT DOCUMENTS

| | | | |
|---|---|---|---|
| EP | 2980317 A1 | 2/2016 | |
| EP | 3358087 A1 * | 8/2018 | E02F 3/286 |

OTHER PUBLICATIONS

International Search Report and Written Opinion dated Feb. 18, 2019 for International Application No. PCT/US2018/058684 filed Nov. 1, 2018, 13 pages.

* cited by examiner

*Primary Examiner* — Thomas G Black
*Assistant Examiner* — Tarek Elarabi
(74) *Attorney, Agent, or Firm* — John Veldhuis-Kroeze; Westman, Champlin & Koehler, P.A.

(57) ABSTRACT

Power machines such as excavators with control inputs that are configurable to control various functions on the excavator. In some modes, selected control inputs are manipulable to control the position of a lift arm, bucket, and house position. In other modes, the same control inputs are used to control travel and an implement on an undercarriage.

19 Claims, 6 Drawing Sheets

CONTROL SYSTEM FOR POWER MACHINE

CROSS-REFERENCE TO RELATED APPLICATION

This application claims the benefit of U.S. Provisional Application No. 62/580,162, which was filed on Nov. 1, 2017.

BACKGROUND

This disclosure is directed toward power machines. More particularly, this disclosure is directed to excavators and lift arm structures for excavators.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

Excavators are a known type of power machine that have an undercarriage and a house that selectively rotates on the undercarriage. A lift arm to which an implement can be attached is operably coupled to, and moveable under power with respect to, the house. Excavators are also typically self-propelled vehicles. Many power machines have variable displacement (often known as "two-speed") drive motors with two different displacement settings: a first setting known as a low range and a second setting known as a high range. In the so-called low range, the drive motor has a relatively higher displacement (as compared to the high range). This higher displacement provides a relatively higher torque output from the drive motor, but a lower travel speed (hence the name, "low range"). Conversely, in the so-called high range, the drive motor has a lower displacement, thereby reducing the torque output, but allowing for a higher travel speed (hence the name, "high range"). Many of these types of two-speed drive motors are shifted between low and high range by introducing a hydraulic signal to a shifting element in the motor. Tracked excavators have endless tracks that rotate about track frames to propel the machine. These track frames are attached to an undercarriage of the excavator, with the hydraulic system included in the upper machine portion or house of the excavator. The upper machine portion of the excavator pivots with respect to the undercarriage about a vertical axis on a swivel joint or swivel, which allows for unlimited rotational movement of the upper machine portion in either direction relative to the undercarriage.

The discussion above is merely provided for general background information and is not intended to be used as an aid in determining the scope of the claimed subject matter.

SUMMARY

Disclosed are power machines such as excavators with control inputs that are configurable to control various functions on the excavator. In some modes, selected control inputs are manipulable to control the position of a lift arm, bucket, and house position. In other modes, the same control inputs are used to control travel and an implement on an undercarriage.

In an exemplary embodiment, a power machine is provided comprising a frame (110; 210), an operator compartment (250) supported by the frame, a plurality of actuators (470; 472; 474; 476), a first operator input device (466) positioned in the operator compartment and configured to be manipulated by an operator and to responsively provide first input device control signals indicative of the operator's intention to control a first machine function, a second operator input device (468) positioned in the operator compartment and configured to be manipulated by the operator and to responsively provide second input device control signals indicative of the operator's intention to control a second machine function, a mode selection input (464) configured to be manipulated by the operator to select a mode of operation for controlling at least some of the plurality of actuators responsive to actuation of the first and second operator input devices, and a controller (462) coupled to the first and second operator input devices and the mode selection input. The controller is configured to determine a selected mode of operation based upon the mode selection input. The controller is also configured such that when the selected mode of operation is a first mode of operation a first sub-set of the plurality of actuators is controlled by the operator's manipulation of the first and second operator input devices, and such that when the selected mode of operation is a second mode of operation a second sub-set of the plurality of actuators, different than the first sub-set of the plurality of actuators, is controlled by the operator's manipulation of the first and second operator input devices.

In some exemplary embodiments, the first operator input device (466) is a first two-axis joystick and the second operator input device (468) is a second two-axis joystick. Further, in some exemplary embodiments, the power machine is an excavator which further includes tractive elements (140; 240) coupled to a lower frame portion (210) of the frame, an upper frame portion (211) configured to rotate with respect to the lower frame portion (210), a first lift arm structure (230) configured to be moved relative to the upper frame portion, the first lift arm structure including a boom portion (232) and an arm portion (234), the arm portion configured to have a first implement mounted thereto by an implement interface (170), and a second lift arm structure (330) configured to be moved relative to the lower frame portion, the second lift arm structure having a second implement (334) secured thereto.

In some exemplary embodiments, the plurality of actuators includes drive actuators (470) configured to control the tractive elements to control tractive effort of the power machine, a slew actuator (472) configured to control rotation of the upper frame portion relative to the lower frame portion, first lift arm and implement actuators (474, 233B, 233C, 233D) configured to control positioning of the first lift arm structure and the first implement, and a second lift arm actuator (476, 332) configured to control positioning of the second lift arm structure and the second implement.

In some exemplary embodiments, in the first mode of operation, the controller controls a first lift arm and implement actuator (474, 233C) responsive to movement of the first two-axis joystick (466) along a first axis to control positioning of the arm portion (234) of the first lift arm structure relative to the boom portion (232) of the first lift arm structure, and in the second mode of operation the controller controls the drive actuators (470) responsive to movement of the first two-axis joystick (466) along the first axis to control forward and backward travel of the power machine.

In some exemplary embodiments, in the first mode of operation, the controller controls the slew actuator (472)

responsive to movement of the first two-axis joystick (466) along a second axis to control rotation of the upper frame portion relative to the lower frame portion, and in the second mode of operation the controller controls the drive actuators (470) responsive to movement of the first two-axis joystick (466) along the second axis to control left and right turning direction of the power machine.

In some exemplary embodiments, in the first mode of operation, the controller controls a second lift arm and implement actuator (474, 233B) responsive to movement of the second two-axis joystick (468) along a first axis to control positioning of the boom portion (232) of the first lift arm structure relative to the upper frame portion (211), and in the second mode of operation the controller controls the second lift arm actuator (476, 332) responsive to movement of the second two-axis joystick (468) along the first axis to control positioning of the second lift arm structure (330) and the second implement (334) relative to the lower frame portion (210).

In some exemplary embodiments, in the first mode of operation, the controller controls a third lift arm and implement actuator (474, 233D) responsive to movement of the second two-axis joystick (468) along a second axis to control positioning of the implement interface and the first implement relative to the arm portion (234) of the first lift arm structure, and in the second mode of operation the controller controls the slew actuator (472) responsive to movement of the second two-axis joystick (468) along the second axis to control rotation of the upper frame portion relative to the lower frame portion.

In another exemplary embodiment, a method is provided for selecting a mode of operation for user input devices on a power machine and controlling the power machine. The method includes receiving (502) a mode selection input from a mode selection input device (464), determining (504) a selected mode of operation, from at least two modes of operation, based upon the mode selection input, and configuring (506, 508) a controller to analyze inputs from first and second user input devices (466, 468) based upon the determined selected mode of operation and controlling machine functions, responsive to an operator's manipulation of the first and second user input devices, using the configured controller.

In some exemplary embodiments of the method, receiving (502) the mode selection input from the mode selection input device (464) comprises determining an absence of a signal from the mode selection input device, and wherein determining (504) the selected mode of operation comprises selecting a default mode of operation from the at least two modes of operation.

In some exemplary embodiments of the method, determining (504) the selected mode of operation further comprises determining whether a first mode of operation is selected, and if it is determined that the first mode of operation is selected then configuring the controller comprises configuring (506) the controller to analyze inputs based upon the first mode of operation.

In some exemplary embodiments of the method, if it is determined that the first mode of operation is not selected, then determining that a second mode of operation is selected and then configuring the controller comprises configuring (508) the controller to analyze inputs based upon the second mode of operation.

In some exemplary embodiments of the method, the at least two modes of operation include a trench mode of operation and a backfill mode of operation.

In some exemplary embodiments of the method, the first and second user input devices are first and second two-axis joysticks (466 and 468).

In some exemplary embodiments of the method, configuring a controller to analyze inputs from first and second user input devices based upon the determined selected mode of operation and controlling machine functions, responsive to an operator's manipulation of the first and second user input devices, using the configured controller further comprises configuring the controller such that when the selected mode of operation is a first mode of operation a first sub-set of a plurality of actuators is controlled by the operator's manipulation of the first and second operator input devices, and such that when the selected mode of operation is a second mode of operation a second sub-set of the plurality of actuators, different than the first sub-set of the plurality of actuators, is controlled by the operator's manipulation of the first and second operator input devices.

In another exemplary embodiment, a power machine is provided comprising a first operator input device (466) configured to be manipulated by an operator and to responsively provide first input device control signals indicative of the operator's intention to control a first machine function, a second operator input device (468) configured to be manipulated by the operator and to responsively provide second input device control signals indicative of the operator's intention to control a second machine function, a mode selection input (464) configured to be manipulated by the operator to select a mode of operation from at least two modes of operation, and a controller (462) coupled to the first and second operator input devices and the mode selection input. The controller is configured to determine a selected mode of operation based upon the mode selection input, and to analyze inputs from the first and second user input devices (466, 468) based upon the determined selected mode of operation to control machine functions, responsive to the operator's manipulation of the first and second user input devices.

In some exemplary embodiments, the power machine further comprises a plurality of actuators (470; 472; 474; 476). The controller's configuration to analyze inputs from the first and second user input devices (466, 468) based upon the determined selected mode of operation to control machine functions further comprises the controller being configured such that, when the selected mode of operation is a first mode of operation, a first sub-set of the plurality of actuators is controlled by the operator's manipulation of the first and second operator input devices, and such that when the selected mode of operation is a second mode of operation a second sub-set of the plurality of actuators, different than the first sub-set of the plurality of actuators, is controlled by the operator's manipulation of the first and second operator input devices.

In some exemplary embodiments, the first operator input device (466) is a first two-axis joystick and the second operator input device (468) is a second two-axis joystick. Further, in some embodiments, the power machine is an excavator further comprising a frame (110; 210), an operator compartment (250) supported by the frame, tractive elements (140; 240) coupled to a lower frame portion (210) of the frame, an upper frame portion (211) configured to rotate with respect to the lower frame portion (210), a first lift arm structure (230) configured to be moved relative to the upper frame portion, the first lift arm structure including a boom portion (232) and an arm portion (234), the arm portion configured to have a first implement mounted thereto by an implement interface (170), and a second lift arm structure (330) configured to be moved relative to the lower frame portion, the second lift arm structure having a second implement (334) secured thereto. Also in some exemplary embodiments, the plurality of actuators includes drive actuators (470) configured to control the tractive elements to control tractive effort of the power machine, a slew actuator (472) configured to control rotation of the upper frame portion relative to the lower frame portion, first lift arm and implement actuators (474, 233B, 233C, 233D) configured to control positioning of the first lift arm structure and the first implement, and a second lift arm actuator (476, 332) configured to control positioning of the second lift arm structure and the second implement.

This Summary and the Abstract are provided to introduce a selection of concepts in a simplified form that are further described below in the Detailed Description. This Summary is not intended to identify key features or essential features of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for description and should not be regarded as limiting. Words such as "including," "comprising," and "having" and variations thereof as used herein are meant to encompass the items listed thereafter, equivalents thereof, as well as additional items.

Disclosed embodiments illustrate an excavator and a control system for an excavator that provide for a plurality of modes of operation. The control system includes a pair of two-axis operator inputs and a mode select input. In a first mode of operation, the pair of two-axis operator inputs are mapped to control one set of functions on the implement. In a second mode of operation, the pair of two-axis operator inputs are mapped to control a second set of functions on the implement.

Figure 2:
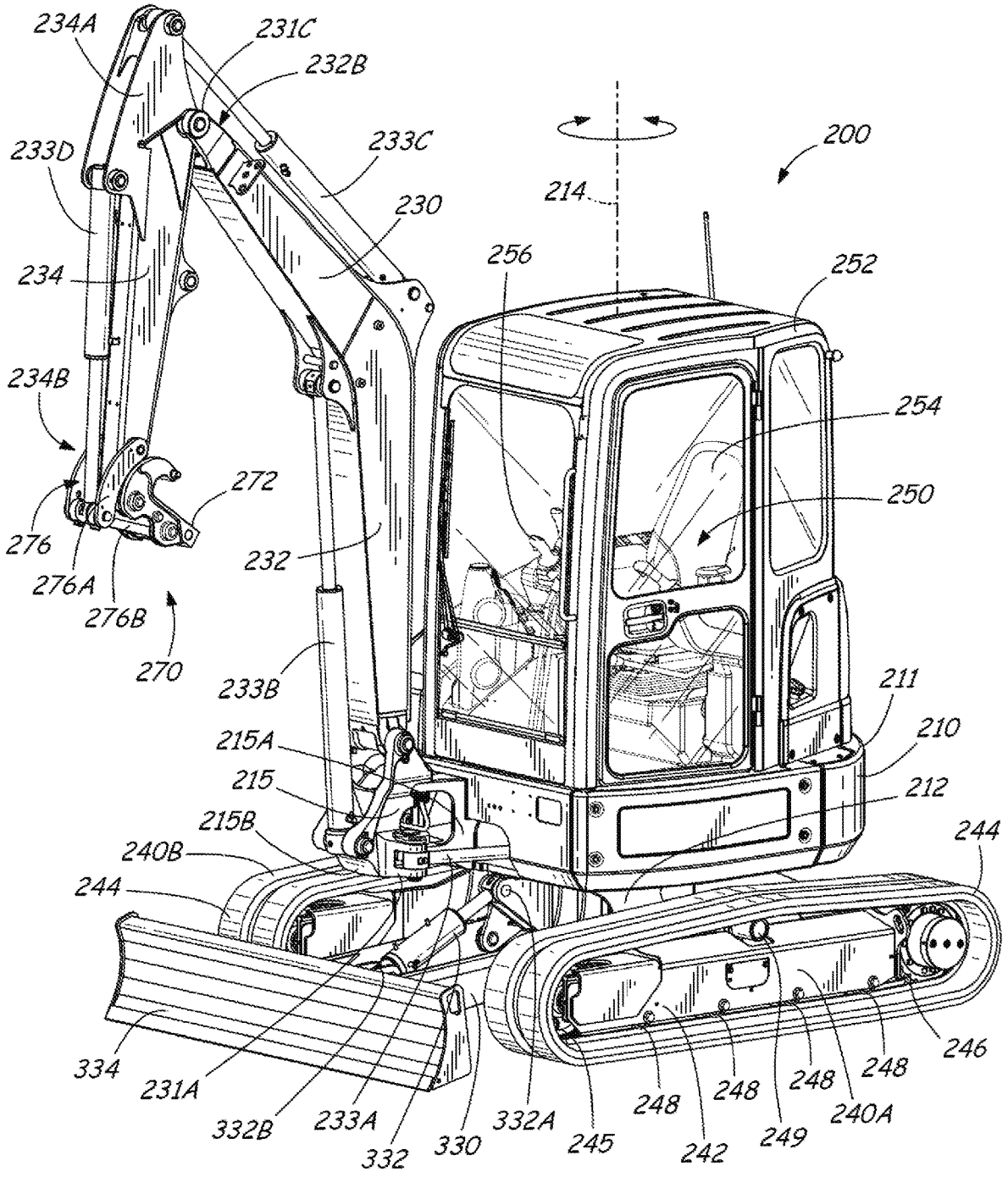
FIG. 2 is a front left perspective view of a representative power machine in the form of an excavator on which the disclosed embodiments can be practiced.
Figure 3:
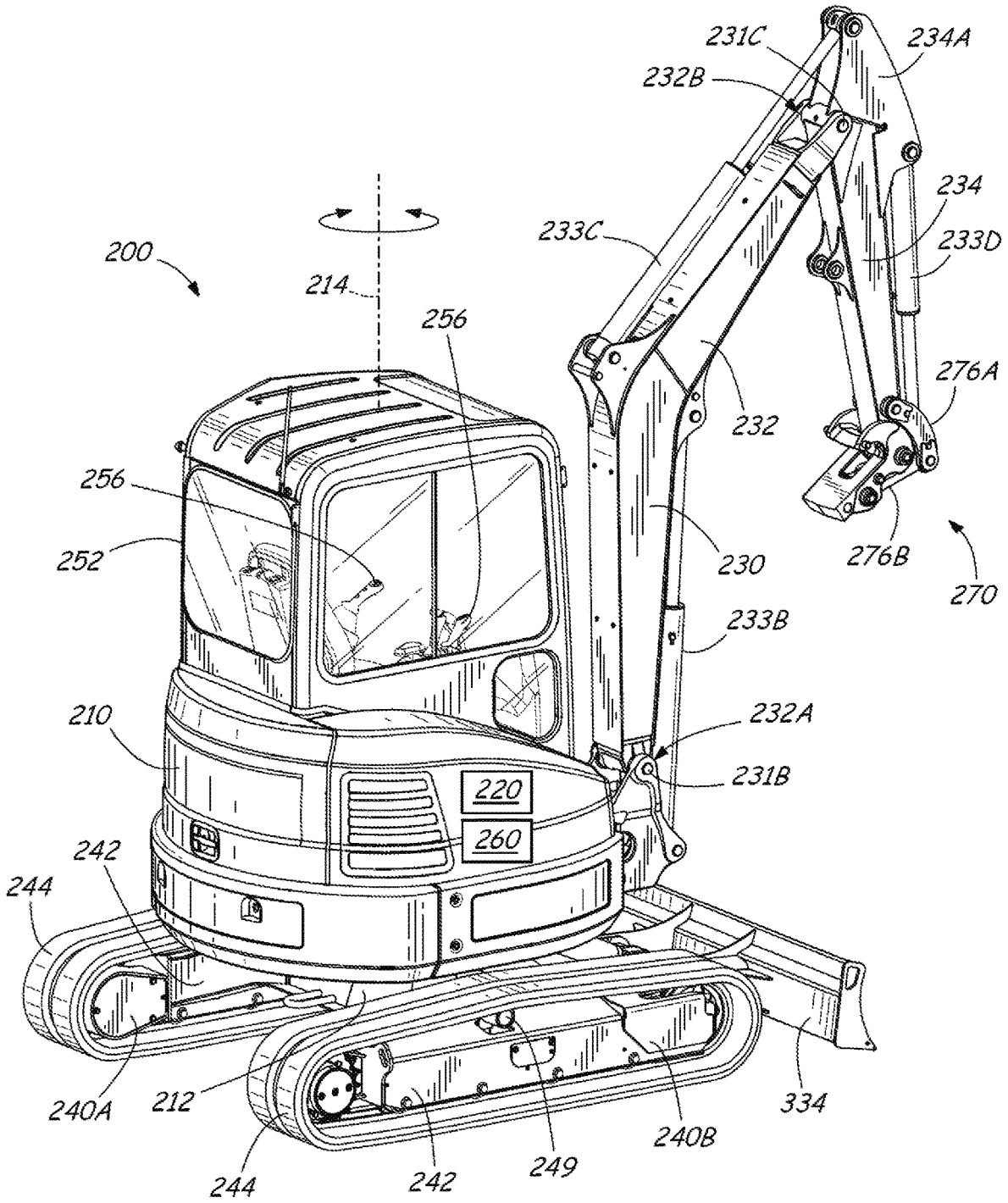
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Figure 1:
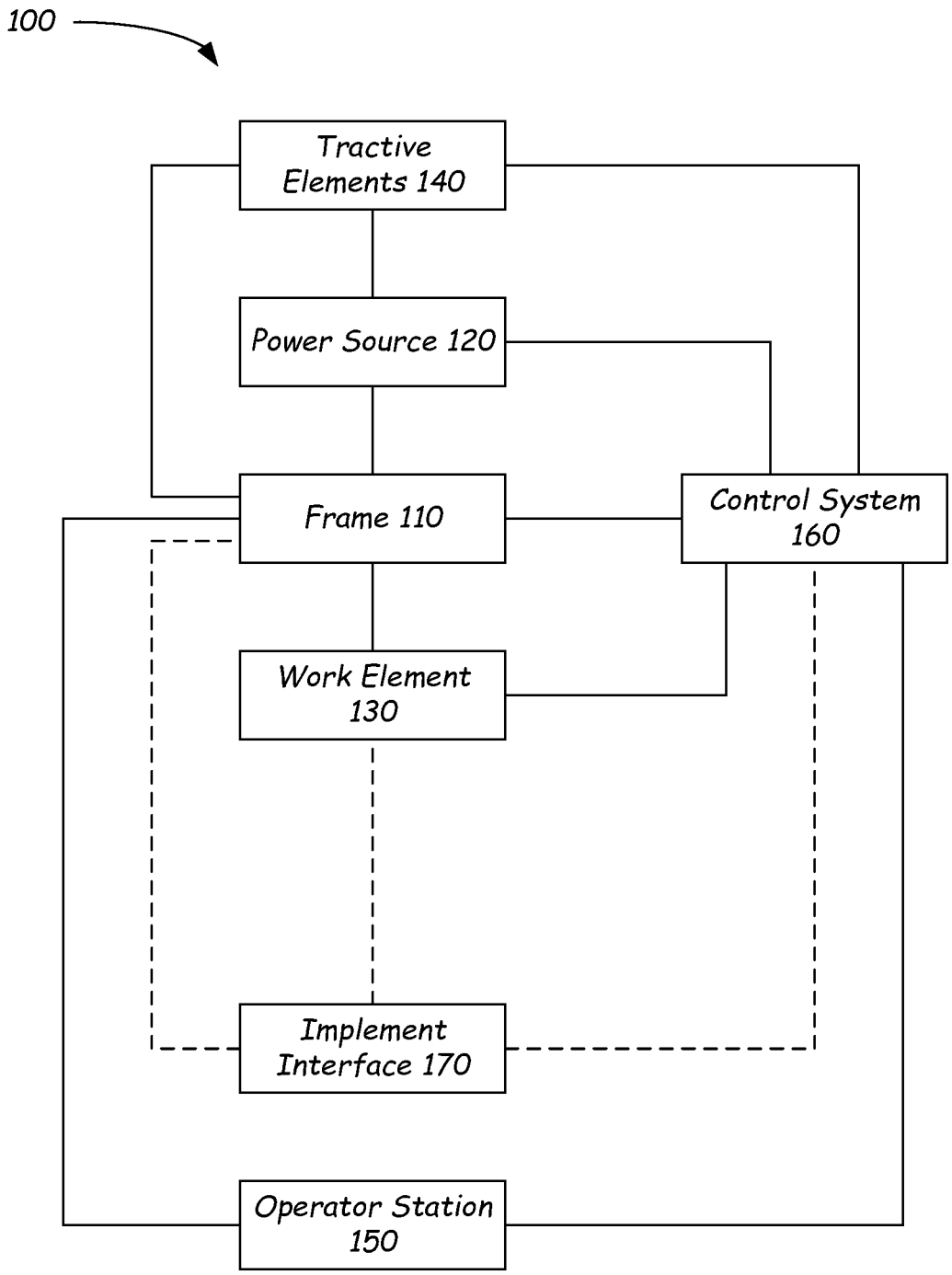
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of several distinct types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of several implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both of the power machine and any implement to which is it coupled) that can control at least some of the operator-controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200. In some embodiments, the operator input devices include at least two two-axis operator input devices to which operator functions can be mapped.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion 232, known generally as a boom, and a second portion 234, known as an arm or a dipper. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that can accept and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and preventing the track from rubbing on track frame 242.

A second, or lower, lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334, which in one embodiment is a blade as is shown in FIGS. 2-3. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230 and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
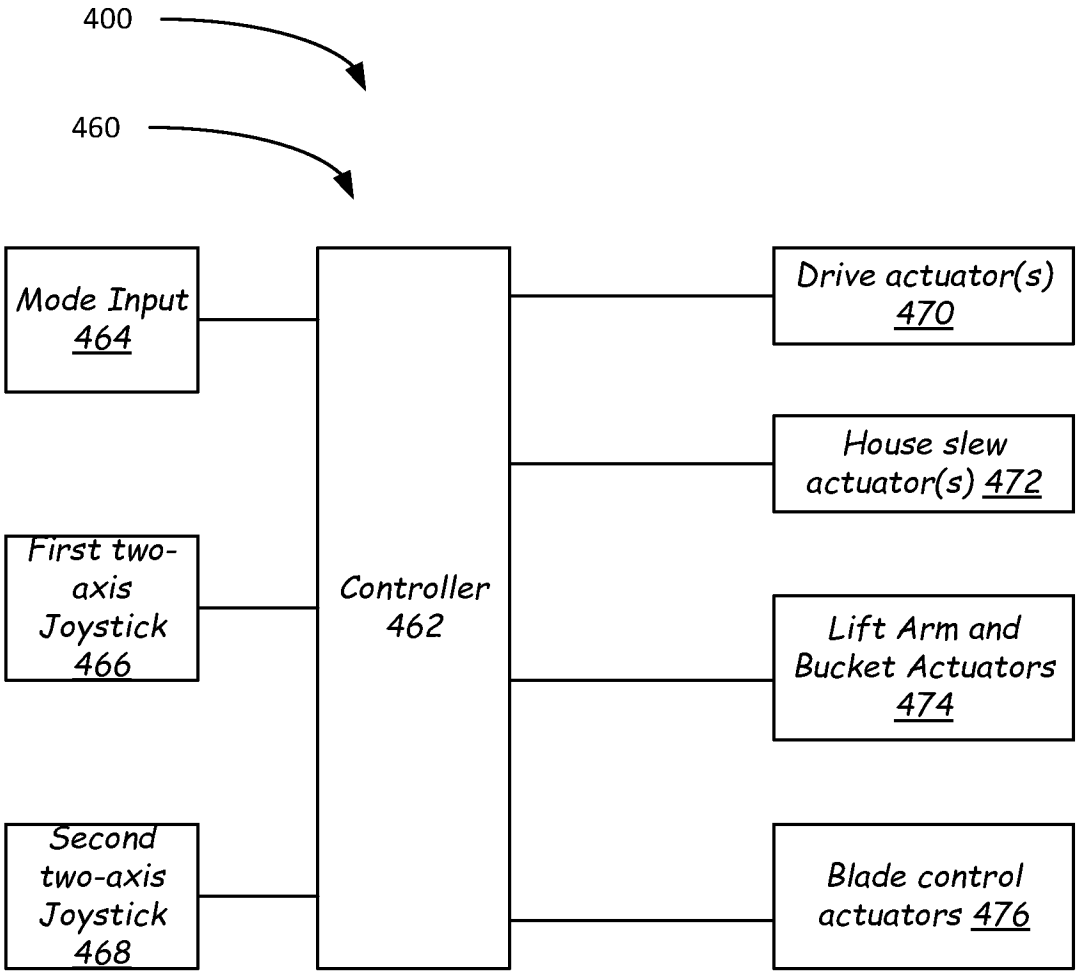
FIG. 4 is block diagram illustrating portions of a control system of an excavator according to one illustrative embodiment.

FIG. 4 is a simplified block diagram that illustrates some functions of a control system 460 for use in a power machine 400, which can be similar to the excavator 200 discussed above. It should be appreciated that a control system for a power machine such as excavator 200 or any other power machine can be more complex than the control system 460 as shown in FIG. 4 and that the simplification of the control system 460 is provided to focus on key features of the control system.

Figure 5:
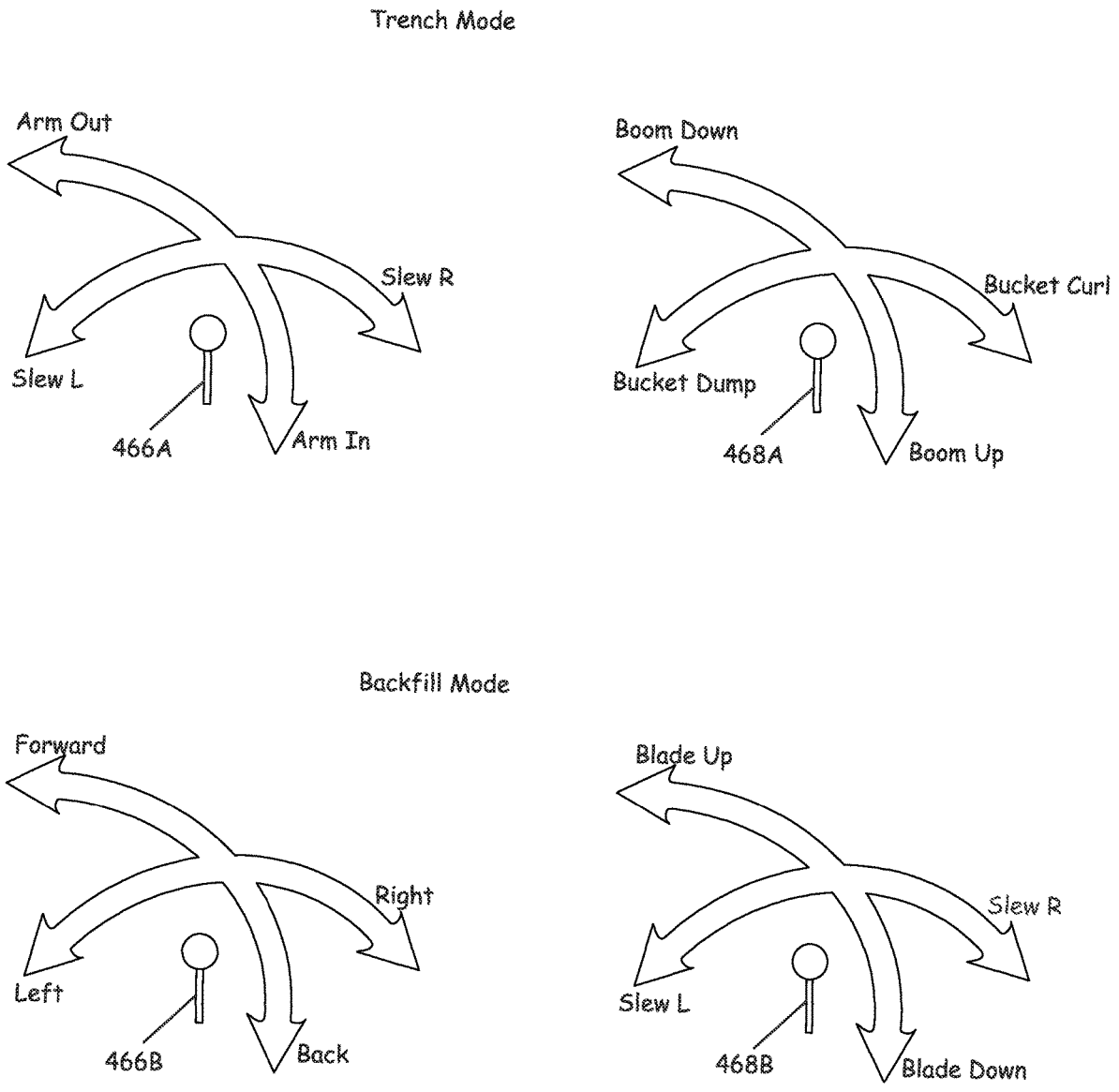
FIG. 5 is a function map diagram illustrating the mapping of control functions to joystick controls in two different modes according to one illustrative embodiment.

Control system 460 includes a controller 462, which can be any suitable electronic controller capable of receiving a plurality of input signals from various input devices and providing output signals for controlling actuation devices. The control system 460 also includes a mode input 464, which is manipulable by an operator to select a mode of operation for controlling functions on the machine via actuation devices. In one embodiment, the control system 460 is configured to operate in a first mode and in a second mode. FIG. 5 illustrates an example of first and second modes, with a first mode being identified as a "trench mode" and the second mode being identified as a "backfill mode". Control system 460 also includes operator inputs that are manipulable by an operator for providing electrical control signals to the controller 462 indicative of an operator's intention to control a machine function. As illustrated in FIG. 4, the operator inputs include a pair of joysticks: first two-axis joystick 466 and second two-axis joystick 468. The first and second joysticks in various embodiments can be different types of joysticks that can provide voltage or current signals to the controller 460 or serial communication streams, either via a wired or wireless connection.

Controller 462 is also operably coupled to a plurality of actuators that are configured to control machine functions on the power machine 400. These actuators illustratively include one or more drive actuators 470 for controlling the tractive effort of the power machine. These drive actuators can be, for example, one or more drive pumps in a hydrostatic drive system or a plurality of valves in a hydraulic drive system. One or more house slew actuators 472 are coupled to the controller. The house slew actuators 472 can rotate a house with respect to an undercarriage. Lift arm and bucket actuators 474 control the positioning of the lift arm and implement. Blade control actuator 476 control the position of a lower implement on a house such as blade 334 shown in FIGS. 2-3.

FIG. 5 illustrates a pair of two-axis joysticks 466 and 468 as they operate in first and second modes according to one illustrative embodiment. In a first mode, the "trench mode", the first and second joysticks are designated as 466A and 468A, respectively. In a second mode, the "backfill" mode, the first and second joysticks are designated as 466B and 468B, respectively. In the trench mode, an operator is typically operating the lift arm to dig and remove soil to dig a trench. During a trenching work cycle, the operator is most often manipulating the lift arm and rotation of the house. In this mode, the first joystick 466A is configured to provide two inputs: one axis of movement signals an intent to rotate the house and a second axis of movement signals an intent to move an arm portion of the lift arm in and out. The arm portion of a lift arm, for reference, is the lower portion of a lift arm (i.e., the arm 234 illustrated in FIGS. 2-3). In the trench mode, the second joystick 468A controls movement of the boom portion of a lift arm (i.e. boom portion 232) and the implement ("bucket dump" and "bucket curl"). In this configuration, the first and second joysticks are optimized to dig and dump material such as might be done when digging a trench.

In a backfilling cycle, an operator is primarily concerned with controlling travel and the lower implement. In the example shown in FIG. 5, the first and second joysticks 466 and 468 are configured for operation in the second mode. In the second mode, the first joystick (designed as 466B to signify second mode operation) controls the direction and speed of travel. In a first axis, the first joystick 466B controls speed and direction (i.e. "forward" and "back"). In a second axis, the first joystick 466B controls turning direction and amount (i.e. "left" and "right"). It should be said that in all these instances, most two-axis joysticks allow simultaneous input from both joysticks, so that an operator and can control speed, direction and turning at the same time. In the second mode, the second joystick 468B controls the position of the lower implement in one axis ("blade up" and "blade down") and rotation of the house in the other axis ("slew left" and slew right").

Figure 6:
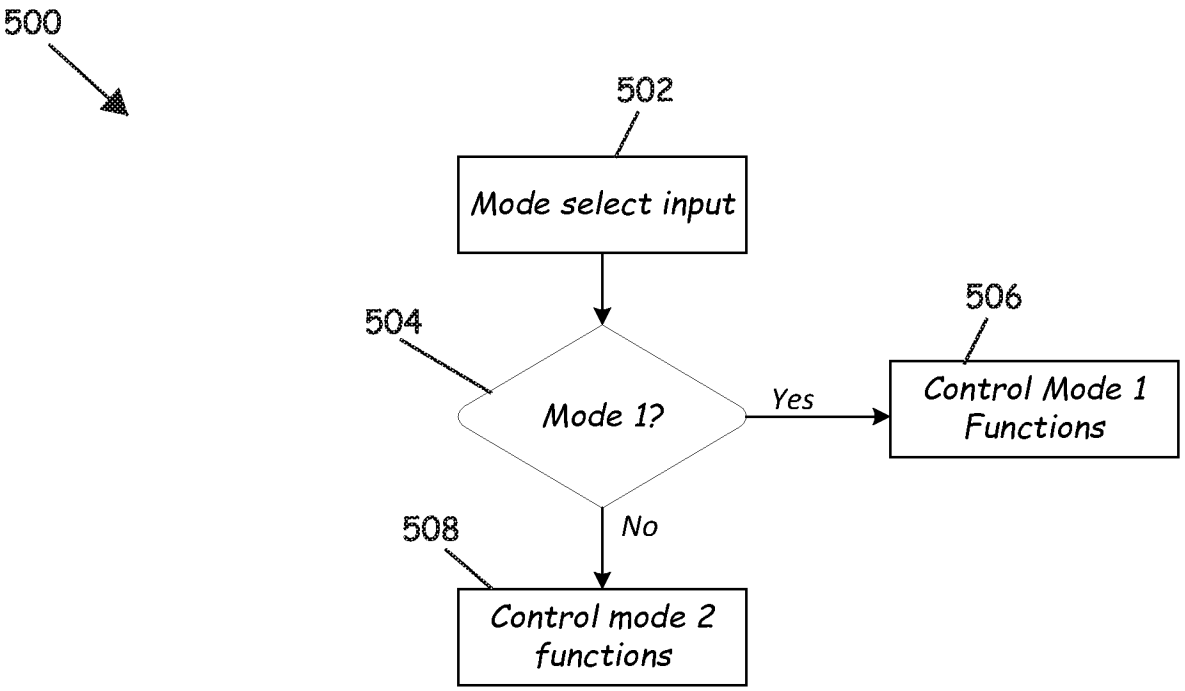
FIG. 6 is a flow diagram illustrating a method of controlling an excavator according to one illustrative embodiment.

FIG. 6 illustrates a method 500 of selecting a mode of operation for user input devices on a power machine according to one illustrative embodiment. The method 500 is described with reference to the control system 460 of FIG. 4 to provide an exemplary reference for understanding the method. The method begins at block 502 when mode input 464 provides an indication that it has been actuated to controller 462. When this indication is provided, the controller 462 analyzes and determines at block 504 whether it is indicating mode 1 (or alternatively which mode is selected). It should be appreciated that the embodiment here illustrates two modes of operation, but in other embodiments, more than two modes of operation can be employed. If it is determined at block 504 that mode 1 is selected, the method moves to block 506 and the controller 462 is configured to analyze the inputs from the first and second joysticks 466 and 468 according to a first mode (such as the trench mode illustrated in FIG. 5). If, however, it is determined at block 506 that the mode 1 is not selected (or that mode 2 is selected), the method moves to block 508 and the controller 462 is configured to analyze the inputs from the first and second joysticks 466 and 468 according to a second mode (such as the backfill mode illustrated in FIG. 5).

Although not shown in the above, in some embodiments, either of the first and second modes may be a default mode such that at startup, the control system 460 defaults to that mode in the absence of any signal from the mode input 464. In other embodiments, the control system 460 may require an input from a mode input 464 before operating in any mode. In yet other embodiments, the mode input 464 may be a detented input, thereby always signaling one or the other mode at all times.

The embodiments discussed above provide important advantages. The joystick input devices are easily manipulable and are well suited to control various machine functions. By selecting between different control modes, the joysticks can be configured to perform specific tasks more easily. For example, by having a mode for controlling drive and an implement mounted to the undercarriage, the excavator can be operated in a mode that is more closely associated with a loader. The same machine can be, in a separate mode, operated more like an excavator.

Although the present invention has been described with reference to preferred embodiments, workers skilled in the art will recognize that changes may be made in form and detail without departing from the scope of the discussion.

What is claimed is:

1. A power machine comprising:

a frame having an upper frame portion and a lower frame portion, the upper frame portion configured to rotate with respect to the lower frame portion;

an operator compartment supported by the frame;

a plurality of actuators, the plurality of actuators including a slew actuator configured to control rotation of the upper frame portion relative to the lower frame portion;

a first operator input device positioned in the operator compartment and configured to be manipulated by an operator and to responsively provide first input device control signals indicative of the operator's intention to control a first machine function;

a second operator input device positioned in the operator compartment and configured to be manipulated by the operator and to responsively provide second input device control signals indicative of the operator's intention to control a second machine function;

a mode selection input configured to be manipulated by the operator, and to responsively provide an indication of the manipulation by the operator, to select a mode of operation for controlling at least some of the plurality of actuators responsive to actuation of the first operator input device and the second operator input device; and a controller coupled to the first operator input device, the second operator input device and the mode selection input, wherein the controller is configured to determine a selected mode of operation based upon the indication provided by the mode selection input, the controller configured such that when the selected mode of operation is a first mode of operation a first sub-set of the plurality of actuators is controlled by the operator's manipulation of the first operator input device and the second operator input device, and such that when the selected mode of operation is a second mode of operation a second sub-set of the plurality of actuators, wherein the second sub-set includes at least one actuator that is not a part of the plurality of actuators in the first sub-set, is controlled by the operator's manipulation of the first operator input device and the second operator input device, and wherein the first sub-set of the plurality of actuators and the second sub-set of the plurality of actuators both include at least one common actuator, and wherein the at least one common actuator includes the slew actuator such that the slew actuator is included in both of the first sub-set of the plurality of actuators and the second sub-set of the plurality of actuators and such that the slew actuator is controlled by one of the first operator input device and the second operator input device in the first mode of operation and in the second mode of operation.

2. The power machine of claim 1, wherein the first operator input device is a first two-axis joystick and the second operator input device is a second two-axis joystick.

3. The power machine of claim 2, wherein the power machine is an excavator, further comprising:

tractive elements coupled to the lower frame portion of the frame;

a first lift arm structure configured to be moved relative to the upper frame portion, the first lift arm structure including a boom portion and an arm portion, the arm portion configured to have a first implement mounted thereto by an implement interface; and a second lift arm structure configured to be moved relative to the lower frame portion, the second lift arm structure having a second implement secured thereto.

4. The power machine of claim 3, wherein the plurality of actuators further includes drive actuators configured to control the tractive elements to control tractive effort of the power machine, first lift arm and implement actuators configured to control positioning of the first lift arm structure and the first implement, and a second lift arm actuator configured to control positioning of the second lift arm structure and the second implement.

5. The power machine of claim 4, wherein in the first mode of operation, the controller controls a first lift arm and implement actuator responsive to movement of the first two-axis joystick along a first axis to control positioning of the arm portion of the first lift arm structure relative to the boom portion of the first lift arm structure, and in the second mode of operation the controller controls the drive actuators responsive to movement of the first two-axis joystick along the first axis to control forward and backward travel of the power machine.

6. The power machine of claim 5, wherein in the first mode of operation, the controller controls the slew actuator responsive to movement of the first two-axis joystick along a second axis to control rotation of the upper frame portion relative to the lower frame portion, and in the second mode of operation the controller controls the drive actuators responsive to movement of the first two-axis joystick along the second axis to control left and right turning direction of the power machine.

7. The power machine of claim 6, wherein in the first mode of operation, the controller controls a second lift arm and implement actuator responsive to movement of the second two-axis joystick along a first axis to control positioning of the boom portion of the first lift arm structure relative to the upper frame portion, and in the second mode of operation the controller controls the second lift arm actuator responsive to movement of the second two-axis joystick along the first axis to control positioning of the second lift arm structure and the second implement relative to the lower frame portion.

8. The power machine of claim 7, wherein in the first mode of operation, the controller controls a third lift arm and implement actuator responsive to movement of the second two-axis joystick along a second axis to control positioning of the implement interface and the first implement relative to the arm portion of the first lift arm structure, and in the second mode of operation the controller controls the slew actuator responsive to movement of the second two-axis joystick along the second axis to control rotation of the upper frame portion relative to the lower frame portion.

9. A method of selecting a mode of operation for user input devices on a power machine and controlling the power machine, the method comprising:

receiving a mode selection input from a mode selection input device;

determining a selected mode of operation, from at least two modes of operation, based upon the mode selection input;

configuring a controller to analyze inputs from first and second user input devices based upon the determined selected mode of operation and controlling machine functions, responsive to an operator's manipulation of the first and second user input devices, using the configured controller; and controlling a first plurality of actuators using the first and second user inputs in a first mode of operation and a second plurality of actuators using the first and second user inputs in a second mode of operation, wherein the first plurality of actuators includes at least one actuator that is not included in the second plurality of actuators, wherein a first actuator in included in each of the first plurality of actuators and the second plurality of actuators, and wherein the first actuator is controlled using the first user input in the first mode of operation and is controlled using the second user input in the second mode of operation.

10. The method of claim 9, wherein receiving the mode selection input from the mode selection input device comprises determining an absence of a signal from the mode selection input device, and wherein determining the selected mode of operation comprises selecting a default mode of operation from the at least two modes of operation.

11. The method of claim 9, wherein determining the selected mode of operation further comprises determining whether a first mode of operation is selected, and if it is determined that the first mode of operation is selected then configuring the controller comprises configuring the controller to analyze inputs based upon the first mode of operation.

12. The method of claim 11, wherein if it is determined that the first mode of operation is not selected, then determining that a second mode of operation is selected and then configuring the controller comprises configuring the controller to analyze inputs based upon the second mode of operation.

13. The method of claim 9, wherein the at least two modes of operation include a trench mode of operation and a backfill mode of operation.

14. The method of claim 13, wherein the first and second user input devices are first and second two-axis joysticks, and wherein the first actuator is a slew actuator configured to control a slew function of the power machine.

15. A power machine comprising:

a first operator input device configured to be manipulated by an operator and to responsively provide first input device control signals indicative of the operator's intention to control a first machine function, wherein the first operator input device includes a first two-axis joystick;

a second operator input device configured to be manipulated by the operator and to responsively provide second input device control signals indicative of the operator's intention to control a second machine function, wherein the second operator input device includes a second two-axis joystick;

a mode selection input configured to be manipulated by the operator, and to responsively provide an indication of the manipulation by the operator, to select a mode of operation from at least two modes of operation; and a controller coupled to the first operator input device, the second operator input device and the mode selection input, wherein the controller is configured to determine a selected mode of operation based upon the indication provided by the mode selection input, and to analyze inputs from the first operator input device and the second operator input device based upon the determined selected mode of operation to control machine functions, responsive to the operator's manipulation of the first operator input device and the second operator input device such that when the selected mode of operation is a first mode of operation a first sub-set of machine functions is controlled by the operator's manipulation of the first operator input device and the second operator input device, and such that when the selected mode of operation is a second mode of operation a second sub-set of machine functions, wherein the second sub-set includes at least one machine function that is not a part of the machine functions in the first sub-set, is controlled by the operator's manipulation of the first operator input device and the second operator input device, wherein a first machine function is included in each of the first sub-set of machine functions and the second sub-set of machine functions, and wherein the first machine function is controlled using the first operator input device in the first mode of operation and is controlled using the second operator input device in the second mode of operation.

16. The power machine of claim 15, and further comprising a plurality of actuators, wherein the controller being configured to analyze inputs from the first operator input device and the second operator input device based upon the determined selected mode of operation to control machine functions further comprises the controller being configured such that, when the selected mode of operation is a first mode of operation, a first sub-set of the plurality of actuators is controlled by the operator's manipulation of the first operator input device and the second operator input device, and such that when the selected mode of operation is a second mode of operation a second sub-set of the plurality of actuators, different than the first sub-set of the plurality of actuators, is controlled by the operator's manipulation of the first operator input device and the second operator input device.

17. The power machine of claim 16, wherein the power machine is an excavator, further comprising:

a frame;

an operator compartment supported by the frame;

tractive elements coupled to a lower frame portion of the frame;

an upper frame portion configured to rotate with respect to the lower frame portion;

a first lift arm structure configured to be moved relative to the upper frame portion, the first lift arm structure including a boom portion and an arm portion, the arm portion configured to have a first implement mounted thereto by an implement interface; and a second lift arm structure configured to be moved relative to the lower frame portion, the second lift arm structure having a second implement secured thereto.

18. The power machine of claim 17, wherein the plurality of actuators includes drive actuators configured to control the tractive elements to control tractive effort of the power machine, a slew actuator configured to control rotation of the upper frame portion relative to the lower frame portion, first lift arm and implement actuators configured to control positioning of the first lift arm structure and the first implement, and a second lift arm actuator configured to control positioning of the second lift arm structure and the second implement.

19. The power machine of claim 18, wherein the first machine function is control of the slew actuator to control rotation of the upper frame portion relative to the lower frame portion, and wherein the slew actuator is controlled by the first two-axis joystick in the first mode of operation and is controlled by the second two-axis joystick in the second mode of operation.

* * * * *